US007690131B2

(12) United States Patent
Mausser et al.

(10) Patent No.: US 7,690,131 B2
(45) Date of Patent: Apr. 6, 2010

(54) DEVICE FOR CONTINUOUS DRYING OF A PULP WEB

(75) Inventors: Wilhelm Mausser, Graz (AT); Gerald Schadler, Vasoldsberg (AT)

(73) Assignee: Andritz AG, Graz (AT)

( * ) Notice: Subject to any disclaimer, the term of this patent is extended or adjusted under 35 U.S.C. 154(b) by 0 days.

(21) Appl. No.: 11/168,771

(22) Filed: Jun. 28, 2005

(65) Prior Publication Data

US 2005/0283994 A1 Dec. 29, 2005

(30) Foreign Application Priority Data

Jun. 28, 2004 (AT) ..... A 1095/2004

(51) Int. Cl.
*F26B 11/02* (2006.01)

(52) U.S. Cl. ..... 34/124; 162/358.1

(58) Field of Classification Search ..... 34/115–124; 162/358.1

See application file for complete search history.

(56) References Cited

U.S. PATENT DOCUMENTS 1,453,113 A * 4/1923 Hutchins ..... 34/125
1,521,223 A * 12/1924 Wyld ..... 34/454
1,595,238 A * 8/1926 Minton ..... 34/452
1,595,240 A * 8/1926 Minton ..... 34/452
1,595,477 A * 8/1926 Minton ..... 34/452
1,595,478 A * 8/1926 Minton ..... 34/452
1,595,480 A * 8/1926 Minton ..... 34/309
1,669,774 A * 5/1928 O'Malley ..... 34/124
2,081,945 A * 6/1937 Massey et al. ..... 34/422
2,210,070 A * 8/1940 Field ..... 156/153
2,225,166 A * 12/1940 Erby ..... 432/148
2,413,567 A * 12/1946 Hornbostel ..... 34/124
2,822,153 A * 2/1958 Arnold ..... 366/229
3,016,315 A * 1/1962 Robinson ..... 138/177
3,028,682 A * 4/1962 Fleissner ..... 34/115
3,151,953 A * 10/1964 Justus ..... 34/118
3,228,462 A * 1/1966 Smith, Jr. ..... 165/89
3,250,019 A * 5/1966 Beachler ..... 34/117
3,276,140 A * 10/1966 Walser et al. ..... 34/110
3,453,712 A * 7/1969 Mackendrick ..... 29/895.22
3,564,686 A * 2/1971 Bryand ..... 492/32
3,618,812 A * 11/1971 Maeder et al. ..... 220/220
3,672,010 A * 6/1972 Fleissner ..... 26/92
3,751,822 A * 8/1973 Crist ..... 34/116
3,762,680 A * 10/1973 Whitacre et al. ..... 249/197
3,773,614 A * 11/1973 Pennington ..... 162/357
3,781,957 A * 1/1974 Luthi ..... 492/32
3,815,885 A * 6/1974 Moulton et al. ..... 267/64.23
RE28,459 E * 7/1975 Cole et al. ..... 34/306
3,902,356 A * 9/1975 Rupf-Bolz ..... 73/49.2
3,989,105 A * 11/1976 Trepaud ..... 165/158
4,124,941 A * 11/1978 Birke et al. ..... 34/421
4,146,972 A * 4/1979 Smith, Jr. ..... 34/454
4,184,268 A * 1/1980 Christin et al. ..... 34/124
4,186,496 A * 2/1980 Beke et al. ..... 34/114
4,266,888 A * 5/1981 Bayer et al. ..... 405/202

(Continued)

*Primary Examiner*—Stephen M Gravini
(74) *Attorney, Agent, or Firm*—Alix, Yale & Ristas, LLP

(57) ABSTRACT

A device for continuous drying of a pulp web, particularly a tissue web, with a drying drum (1) and an air circulating system, where the drying drum (1) has a cylindrical shell (9) designed as a honeycombed body with an annular, flexible transition profile (13) at the edges of the shell and connected to the end covers.

17 Claims, 4 Drawing Sheets

U.S. PATENT DOCUMENTS 4,344,236 A * 8/1982 Lindeen ..... 34/110
4,361,466 A * 11/1982 Wong et al. ..... 162/207
4,369,584 A * 1/1983 Daane ..... 34/392
4,440,214 A * 4/1984 Wedel ..... 165/90
4,447,964 A * 5/1984 Gardner ..... 34/452
4,627,176 A * 12/1986 Brieu ..... 34/115
4,677,762 A * 7/1987 Futcher ..... 34/114
4,683,059 A * 7/1987 LaValley ..... 210/404
4,744,156 A * 5/1988 Futcher ..... 34/114
4,781,795 A * 11/1988 Miller ..... 162/358.5
4,807,371 A * 2/1989 Wedel ..... 34/117
4,815,220 A * 3/1989 Wedel ..... 34/120
4,835,881 A * 6/1989 Welsby ..... 34/117
4,882,854 A * 11/1989 Wedel et al. ..... 34/115
4,894,006 A * 1/1990 Cassagne et al. ..... 431/116
4,918,836 A * 4/1990 Wedel ..... 34/458
4,970,805 A * 11/1990 Wedel ..... 341/115
4,973,385 A * 11/1990 Jean et al. ..... 162/368
5,101,577 A * 4/1992 Wedel ..... 34/114
5,347,728 A * 9/1994 Pinter et al. ..... 34/115
5,404,653 A * 4/1995 Skaugen et al. ..... 34/117
5,416,979 A * 5/1995 Joiner ..... 34/114
5,437,107 A * 8/1995 Ensign et al. ..... 34/117
5,495,679 A * 3/1996 Deshpande et al. ..... 34/117
5,528,838 A * 6/1996 Timm et al. ..... 34/124
5,628,124 A * 5/1997 Skaugen et al. ..... 34/117
5,738,760 A * 4/1998 Svanqvist et al. ..... 162/193
5,791,065 A * 8/1998 Gamble et al. ..... 34/110
5,832,625 A * 11/1998 Skaugen et al. ..... 34/117
5,845,037 A * 12/1998 Miekis ..... 385/136
5,915,813 A * 6/1999 Joiner ..... 34/115
6,032,383 A 3/2000 Fleissner ..... 34/115
6,038,789 A * 3/2000 Kaihovirta et al. ..... 34/448
6,094,838 A * 8/2000 Lang ..... 34/117
6,108,936 A * 8/2000 Vuorinen ..... 34/425
6,328,852 B1 * 12/2001 McGary et al. ..... 162/199
6,343,424 B1 * 2/2002 Erkelenz ..... 34/117
6,668,559 B2 * 12/2003 Calvez et al. ..... 60/796
6,683,284 B2 * 1/2004 Nyman et al. ..... 219/469
6,877,246 B1 * 4/2005 Hada et al. ..... 34/119
6,916,404 B2 * 7/2005 Komulainen et al. ..... 162/193
6,964,117 B2 * 11/2005 Parent ..... 34/528
7,001,487 B2 * 2/2006 Clarke et al. ..... 162/283
7,060,163 B2 * 6/2006 Haider et al. ..... 162/375
7,192,506 B2 * 3/2007 Linden ..... 162/122
RE39,601 E * 5/2007 Svanqvist et al. ..... 162/193
7,311,805 B2 * 12/2007 Clarke et al. ..... 162/283
2004/0035539 A1 * 2/2004 Komulainen et al. ..... 162/193
2004/0050517 A1 * 3/2004 Juppi et al. ..... 162/193
2005/0283994 A1 * 12/2005 Mausser et al. ..... 34/453

* cited by examiner

DEVICE FOR CONTINUOUS DRYING OF A PULP WEB

BACKGROUND OF THE INVENTION

The invention relates to a device for continuous drying of a pulp web, particularly a tissue web, with a drying drum and an air circulating system, where the drying drum has a cylindrical shell designed as a honeycombed body.

In conventional tissue plants, the drying process begins at an ingoing dryness of some 40 to 45%. In order to achieve higher paper volume, papermakers now dispense with preliminary mechanical dewatering, and the ingoing dryness of this newer type of device is around 20 to 25%. These plants operate with through-air drying. During the heating process, one or more consecutive through-air drying drums at ambient temperature are exposed abruptly to the supply air temperature of approximately 300° C. The drying drums currently in use have a thin-walled shell, for example a perforated or honeycombed body, that is joined to thick-walled end flanges. Due to the substantial differences in mass between drum shell and end flange, there is excessive stress at the transition points that leads to deformation and even structural damage. The same damage occurs if the drums are cooled down abruptly from operating to ambient temperature during an emergency shutdown, when they are sprayed with cold water in order to prevent the plastic wires enclosing the drums from being damaged.

SUMMARY OF THE INVENTION

The invention now aims to eliminate this disadvantage and is characterized by the honeycombed cylinder shell of the drying drum having an annular, flexible transition profile at the edges. Thus, any changes occurring in diameter and any resulting thermal stress can be reduced.

An advantageous further development of the invention is characterized by the transition profile being designed as a U-profile and preferably being butt-welded onto the honeycombed cylinder shell. With this design of transition piece, continuous heat transition is guaranteed during both the heating and the cooling process of the machine. The special type of joint leads to a reduction of the stresses in the welds to such extent that the welds suffer no deformation or structural damage at all.

A favorable embodiment of the invention is characterized by the cross-section of the transition profile, preferably a U-profile, narrowing towards its center. As a result, the heat flow can be influenced particularly well. In addition, this design creates a flexible connection, which also guarantees that the cylinder shell is centered and thus, runs exactly true.

It is an advantage if the honeycombed cylinder shell is wider than the paper web to be dried, thus allowing a defined variation of the paper web width.

A favorable further development of the invention is characterized by an endless ring being shrunk on at each end and which extends beyond the transition profile and into the honeycombed cylinder shell. This prevents dust or fibers from entering the cavity of the U-profile.

It has proved favorable to make the cylinder shell out of longitudinal ribs that are connected to upright, edged profiles. This achieves good stability in the cylinder shell.

A favorable embodiment of the invention is characterized by the longitudinal ribs of the honeycombed cylinder shell being spaced at a distance of between 20 and 80 mm from one another, preferably between 30 and 40 mm. If the spacing is narrower, there is also less specific load and thus, reduced risk of marks on the paper web.

An advantageous embodiment of the invention is characterized by the edged connecting profiles mounted in a honeycombed pattern protruding beyond the longitudinal ribs and supporting the paper web and the conveying wire. This results in a large supporting surface and a further reduction in the risk of marks on the paper web.

It is particularly favorable it the honeycombed cylinder shell has an open area of at least 85%. The through-air drying process can thus be implemented particularly well.

A particularly favorable further development of the invention is characterized by covers being provided on the face ends to stabilize the cylinder shell and by these covers being bolted to the cylinder shell, particularly to the transition pieces. This design guarantees improved stability of the drum shell; in particular, it prevents any sliding movement by the end cover and the drum shell if there is radial expansion caused by the temperature.

An advantageous embodiment of the invention is characterized by the drying drum having a fully welded drum body. This design virtually excludes the risk of any areas where cracks could occur.

BRIEF DESCRIPTION OF THE DRAWINGS

The invention will now be described in examples and referring to the drawings, where.

DESCRIPTION OF THE PREFERRED EMBODIMENT

Figure 1:
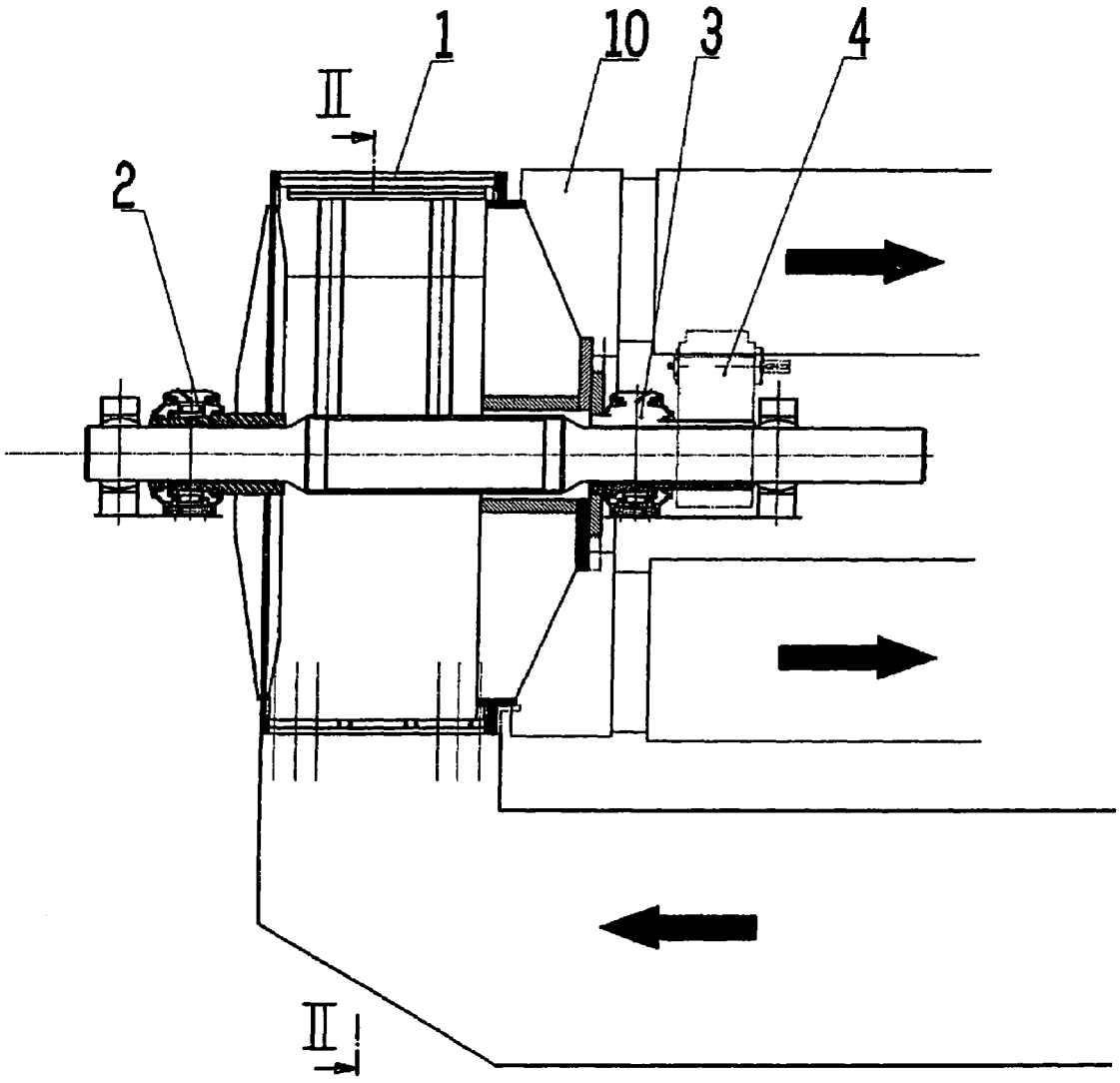
FIG. 1 shows a variant of a configuration of a through-air drying unit.

FIG. 1 shows a possible configuration of a through-air drying process. The figure shows the drum 1 with its bearings 2 and 3, and the drive 4.

Figure 2:
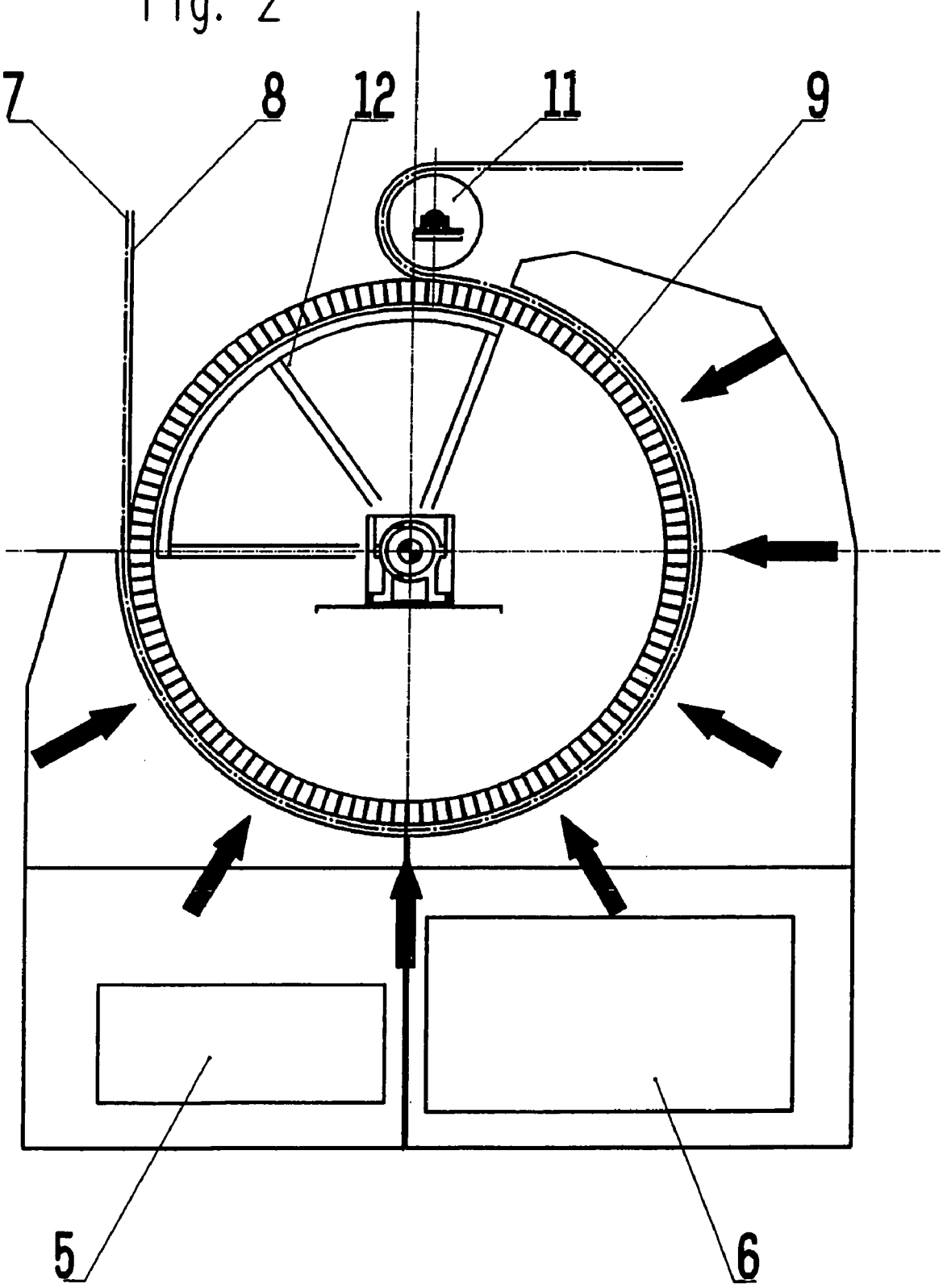
FIG. 2 is a sectional view through FIG. 1 along the line marked II-II.

Beneath the drum there is a two-part hood 5 and 6 (see FIG. 2) from which the hot supply air flows through the paper web, through a conveying wire 8, then through the drying drum 1 into the inside of the drum, and is removed from the drum on the drive side through an annular channel 10. The hot supply air at a temperature of approximately 300° C. is cooled down to approximately 120° C. by the drying process. The exhaust air cooled in this way is then returned to its entry status in a processing system. At the outlet, the paper web 7 with the conveying wire 8 is carried over a deflection roll 11. The cover device 12 is clearly visible here, covering the area of the drum 1 from the inside outwards in the sector that does not come into contact with the tissue web 7 and which also is not enclosed by the hood 5 and 6. This prevents additional air from being drawn into the drying drum, which would greatly reduce the suction effect through the paper web. In principle, the air can also be conveyed from the inside of the drying drum 1 through the cylinder shell 9 to the outside.

Figure 3:
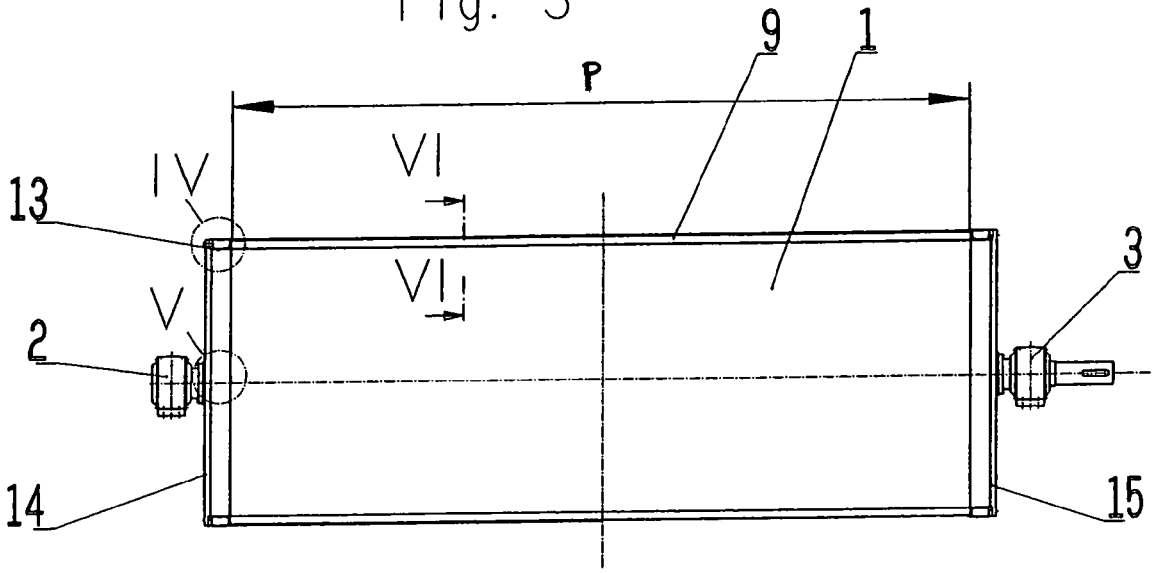
FIG. 3 shows a drying drum according to the invention.

FIG. 3 show a sectional view through a drying drum 1, comprising a perforated, preferably honeycombed cylinder shell 9 with a flexible ring 13 rolled into a horizontal U-profile, butt-welded onto the edges of the shell on both the operator and the drive side. Due to this U-shaped transition profile 13 between cylinder shell 9 and end covers 14, 15, the maximum stresses in the connecting weld are reduced to approximately one third of those occurring in conventional designs, which guarantees damage-free operation of the drying drum over its entire service life.

Figure 4:
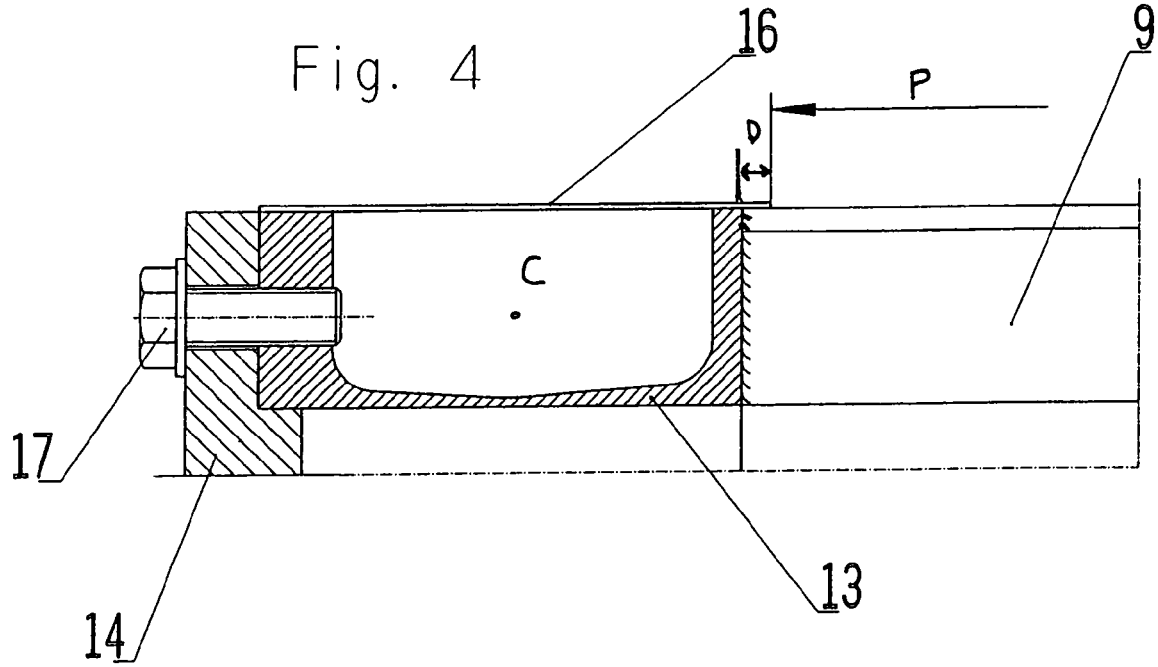
FIG. 4 shows detail IV in FIG. 3.

FIG. 4 shows a sectional view of the connection between the drum shell and the flexible ring 13, as well as the weld joint itself and the bolted connection 17 to the drum cover 14. As viewed in section, each flexible ring 13 is preferably a unitary (or two half-ring) member having a radially extending, relatively rigid inner rim portion that is butt welded to the outer edges of the longitudinal ribs 18 (see FIG. 6), and a radially extending, relatively rigid outer rim portion that forms a flange for the bolted connection to a mating flange portion of the cover. A relatively thin, flexible, web portion extends axially between the inner and outer rim portions, forming the preferred "U" profile in section. As used herein, "flexible" should be understood in the context as semi-rigid with the capability to bend or flex under thermal or mechanical stresses, while retaining sufficient rigidity to transmit the rotational drive torque between one or both covers 14, 15 and the shell body 9. A cavity or channel is formed by the flange portions and the web, and can be considered as having a center C that lies on an imaginary circle around the drum axis. Likewise, the web can be considered as having a center that lies in radial alignment with the center of the channel, and preferably has a varying width along the direction between the flange portions, which narrows toward the center.

The external flanges of these flexible rings 13 are bolted to the drum covers 14 and 15, which have journals to hold the two bearing assemblies 2 and 3 that are designed to take account of the changing length of the drying drum 1 in cross-machine direction, caused by the differences in temperature during heating up and cooling down. The temperature of the exhaust air is normally around 120° C., while the supply air entering the drying drum has a temperature of approximately 300° C. The two ends of the drum including flexible ring 13 are covered by an endless imperforate protective ring 16 from the outer edge of the outer flange portion inwardly beyond the inner flange portion to the edges P of the paper web. This arrangement prevents any dust or fibers from entering the cavity in the U-profile. This endless ring 16 is shrunk on in such a way that it cannot detach itself from the drum surface during the heating and cooling process, nor during drying operation.

Figure 5:
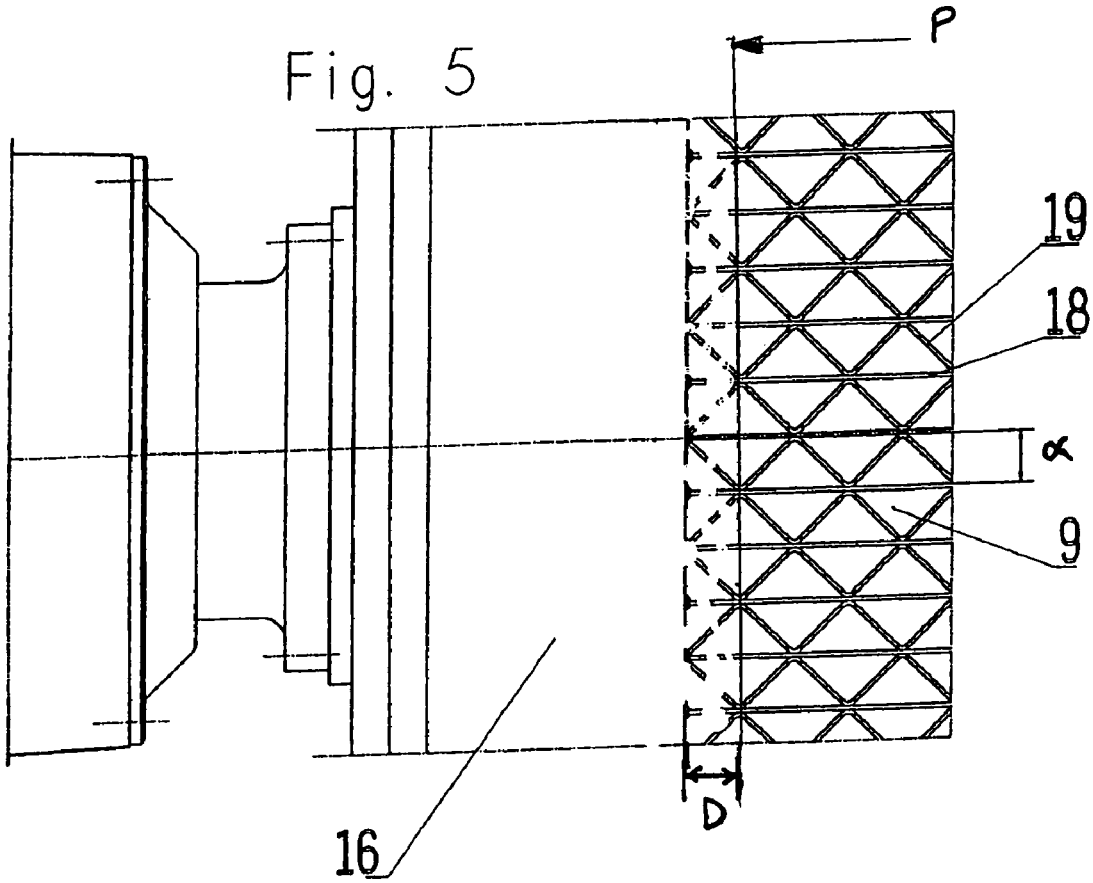
FIG. 5 shows detail V in FIG. 3.

A view of the peripheral sector of the drum 1 is illustrated in FIG. 5. This drawing shows the covering ring 16, which extends inwardly beyond the outer edges of the honeycombed cylinder shell 9 a distance D and marks the edges P of the paper web.

Figure 6:
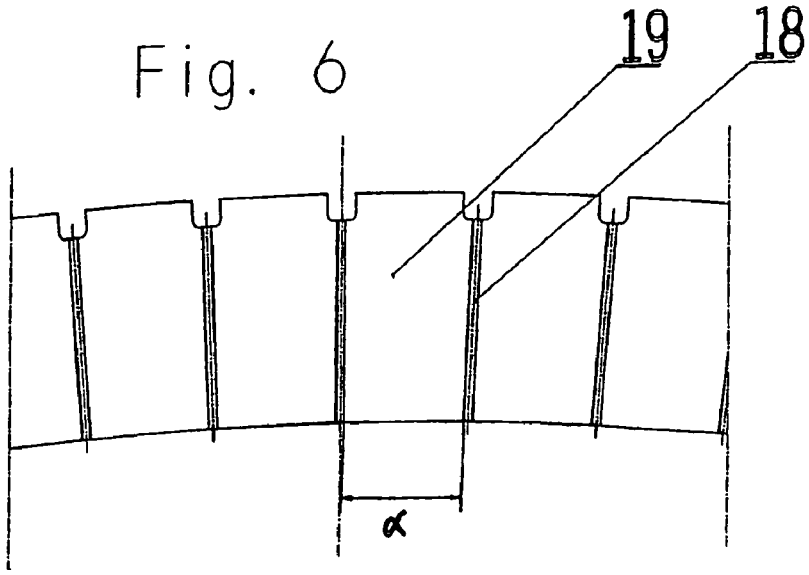
FIG. 6 a sectional view along the line marked VI-VI in FIG. 3.

FIG. 6 shows the supporting structure of the cylinder shell 9 with longitudinal ribs 18, with advantageous spacing $\alpha$ of approximately 30 to 40 mm and the connecting profiles 19 protruding beyond the longitudinal ribs in radial direction to form the honeycomb and support the paper web 7 and the conveying wire 8.

The invention claimed is:

1. Device for continuous drying of a pulp web with a drying drum having a rotation axis extending in an axial direction to opposite axial ends, and an air circulating system, where the drying drum has a perforated cylindrical shell with circular edges at the axial ends of the shell and drum end covers at the axial ends of the drum, wherein the improvement comprises that the shell is connected to the covers at each edge by an annular, flexible transition profile;

the transition profile is a distinct piece having a U-profile in cross section, having an inner end welded onto the edge of the shell and an outer end directly connected to a cover; and the cross-section of the transition profile has a center between the inner and outer ends and the profile narrows towards said center.

2. Device according to claim 1, wherein the shell is wider than the web to be dried.

3. Device according to claim 2, wherein an endless ring is shrunk onto the transition profile and extends beyond the transition profile onto the shell.

4. Device according to claim 1, wherein the cylinder shell is a honeycomb made of longitudinal ribs that are rigidly connected to edges of upright connecting members.

5. Device according to claim 4, wherein the longitudinal ribs of the shell are spaced at a distance of between 20 and 80 mm from one another.

6. Device according to claim 4, wherein said connecting members protrude radially beyond the longitudinal ribs for supporting the web.

7. Device according to claim 4, wherein the shell has an open area of at least 85%.

8. Device according to claim 1, wherein said covers are bolted to respective transition pieces.

9. Device according to claim 4, wherein the ribs and the transition profile are welded to each other.

10. Device according to claim 1, wherein the cylinder shell is a honeycomb made of longitudinal ribs that are welded to edges of upright connecting members and the transition profile is welded to the ribs and edges of said connecting members at the axial ends of the shell.

11. Device according to claim 10, wherein the transition profile has outer and inner rigid flanges at said outer and inner ends.

12. Device according to claim 11, wherein the inner flange is welded to the ribs and connecting members of the shell and the outer flange is bolted to an end cover of the drum.

13. Device according to claim 1, wherein the longitudinal ribs of the shell are spaced at a distance of between 30 and 40 mm from one another.

14. Device according to claim 1, wherein said covers are bolted to respective transition pieces.

15. Device according to claim 9, wherein said covers are bolted to respective transition pieces.

16. Device according to claim 10, wherein said covers are bolted to respective transition pieces.

17. Device according to claim 1, wherein the transition profile is a distinct ring having a U-profile in cross section, wherein the inner and outer ends are inner and outer rims that extend radially with respect to the axis and are connected by an axially extending base portion of the U-profile with the inner rim welded onto the edge of the shell and the outer rim directly connected to a cover; and the cross-section of the transition profile has a center between the rims thereof and the base portion narrows towards said center from each rim.

* * * * *